US010532853B2

(12) United States Patent
Austin

(10) Patent No.: US 10,532,853 B2
(45) Date of Patent: Jan. 14, 2020

(54) PRODUCT DISPLAY CONTAINER

(71) Applicant: Easy Gardener Products, Inc., Waco, TX (US)

(72) Inventor: Douglas E Austin, Lorena, TX (US)

(73) Assignee: Easy Gardener Products, Inc., Waco, TX (US)

( * ) Notice: Subject to any disclaimer, the term of this patent is extended or adjusted under 35 U.S.C. 154(b) by 0 days.

(21) Appl. No.: 15/863,312

(22) Filed: Jan. 5, 2018

(65) Prior Publication Data

US 2019/0210763 A1 Jul. 11, 2019

(51) Int. Cl.

| | |
|---|---|
| ***B65D 19/12*** | (2006.01) |
| ***B65D 19/10*** | (2006.01) |
| ***B65D 19/38*** | (2006.01) |
| *B65D 25/00* | (2006.01) |
| *B65D 25/20* | (2006.01) |

(52) U.S. Cl.

CPC ..... *B65D 19/12* (2013.01); *B65D 19/10* (2013.01); *B65D 19/38* (2013.01); *B65D 25/005* (2013.01); *B65D 25/205* (2013.01); *B65D 2203/00* (2013.01); *B65D 2519/00024* (2013.01); *B65D 2519/00059* (2013.01); *B65D 2519/00164* (2013.01); *B65D 2519/00273* (2013.01); *B65D 2519/00293* (2013.01); *B65D 2519/00298* (2013.01); *B65D 2519/00318* (2013.01); *B65D 2519/00333* (2013.01); *B65D 2519/00502* (2013.01); *B65D 2519/00512* (2013.01); *B65D 2519/00601* (2013.01); *B65D 2519/00611* (2013.01); *B65D 2519/00656* (2013.01); *B65D 2519/00661* (2013.01); *B65D 2519/00805* (2013.01)

(58) Field of Classification Search

USPC ..... 206/386, 600; 220/4.29, 4.34

See application file for complete search history.

(56) References Cited

U.S. PATENT DOCUMENTS

| | | | | |
|---|---|---|---|---|
| 3,246,828 A * | 4/1966 | Branscum | B65D 1/225 | 220/4.34 |
| 3,374,915 A * | 3/1968 | Verhein | B65D 19/12 | 206/511 |
| 3,831,744 A * | 8/1974 | Walden | B65D 19/20 | 206/600 |
| 4,106,626 A * | 8/1978 | Trubiano | B65D 7/26 | 206/513 |
| 4,445,614 A * | 5/1984 | Mitsumori | B65D 19/0016 | 108/53.1 |
| 4,609,116 A * | 9/1986 | Simms | B65D 9/12 | 206/600 |

(Continued)

*Primary Examiner* — Jacob K Ackun

(74) *Attorney, Agent, or Firm* — John A. Powell

(57) ABSTRACT

An apparatus is provided for a collapsible product display container that may be shipped or stored in two main pieces, but which may be assembled at the point of sale by reversible attachment of four side walls to a pallet bottom. The four side walls are hingedly interconnected to each other and are attachable to the pallet bottom in an upright vertical relationship without bolts, screws, or other separate hardware. The container further comprises an advertisement display case that is connected to the back side wall by a hinge and may be moved into a vertical planar alignment above the back side wall of the container by hinging mechanism for marketing purposes.

5 Claims, 5 Drawing Sheets

(56) References Cited

U.S. PATENT DOCUMENTS 4,785,957 A * 11/1988 Beck ..... B65D 19/18 206/503
4,809,851 A * 3/1989 Oestreich, Jr. ..... B65D 7/32 206/511
4,940,155 A * 7/1990 Hewson ..... B65D 11/1833 206/600
5,123,541 A * 6/1992 Giannini ..... B65D 19/20 206/600
5,595,304 A * 1/1997 Timmins ..... B65D 5/542 206/596
5,669,507 A * 9/1997 Pruitt, Jr. ..... B65D 19/16 206/599
RE35,875 E * 8/1998 Shuert ..... 108/55.1
6,006,918 A * 12/1999 Hart ..... B65D 19/12 206/600
6,170,686 B1 * 1/2001 Flores ..... B65D 7/24 220/4.33
6,216,899 B1 * 4/2001 Vicari ..... B65D 19/16 206/600
6,299,011 B1 * 10/2001 Rosenfeldt ..... B65D 9/38 16/388
6,820,761 B1 * 11/2004 Mouri ..... B65D 11/1833 206/600
6,902,061 B1 * 6/2005 Elstone ..... B65D 19/02 206/596
7,896,184 B2 * 3/2011 Meers ..... B65D 11/184 206/600
8,109,402 B2 * 2/2012 Hartwall ..... B65D 19/18 206/600
2004/0040883 A1 * 3/2004 Stone ..... B65D 19/06 206/600
2004/0245248 A1 * 12/2004 Shuert ..... B65D 19/004 220/4.29
2006/0237455 A1 * 10/2006 Vargas ..... B65D 7/24 220/4.34
2009/0057191 A1 * 3/2009 Temple, Jr. ..... B65D 19/12 206/600
2009/0206002 A1 * 8/2009 Austin ..... B65D 19/12 206/766
2014/0246353 A1 * 9/2014 Campagna ..... B65D 19/16 206/600
2014/0284247 A1 * 9/2014 Balazs ..... B65D 19/06 206/600
2015/0027917 A1 * 1/2015 Goddard ..... B65D 19/12 206/386

* cited by examiner

PRODUCT DISPLAY CONTAINER

TECHNICAL FIELD

The techniques described herein relate to a collapsible product display container and its assembly, and particularly to a product display container designed to be easily shipped in two main pieces and then assembled at the point of sale without bolts, screws or other separate hardware, and to have built-in receptacles for insertion and display of marketing materials and banners at the point of sale.

BACKGROUND

Current collapsible containers are known in the art for use as pet crates, or for displaying and shipping products. Most current art collapsible containers require assembly via screws, bolts, or other separate hardware. Some current containers are collapsible, wherein four side walls are designed so as to be independently detachable and are configured to each be vertically inserted into a pallet base or bottom via downward protrusions at the base of the side walls that interact with recesses on the pallet base to engage through vertical motion. Collapsible pallets are also known. Some current foldable pallets that are assembled without screws, bolts, or other similar hardware comprise a pallet bottom having four permanently affixed sides that hinge inward so that the edges of the sides meet and snap together with an attached latch system, wherein the sides are not detachable from the pallet bottom for shipment or storage.

It would be desirable to provide a collapsible pallet/product display container having features desirable for ease of shipping or storage of the containers, ease of assembly at the point of sale, and that also has advantageous product display features that are designed to display banners and other marketing materials after easy assembly of the collapsible pallet/product display container at the point of sale.

SUMMARY

The techniques described herein provide an apparatus for a collapsible product display container comprising four hingedly connected side walls and a pallet bottom configured to allow traditional lifting and moving of the display container following assembly. The four side walls of the product display container are hingedly interconnected to each other so that they may be folded flat for ease of shipment of the container, but such that they may also be expanded to a rectangular form and attached to the pallet bottom to serve as four upright sides of the product container following assembly. The four hingedly connected sides and the pallet bottom may be shipped individually and then easily connected in order to assemble the product display container at the point of sale. The product display container also includes desirable advertising/marketing features for use as a product display container.

In one embodiment, a collapsible product display container is provided. The container may comprise a pallet bottom configured to allow lifting and moving of the display container. The container further comprises four side walls, including a front side wall, a back side wall, and two lateral side walls, wherein the four side walls are permanently hingedly connected to each other, but are reversibly attachable to the pallet bottom. The container may further comprise at least one, and preferably multiple, clamping attachment protrusions that are rigidly affixed to the pallet bottom that will hold the four side walls in upright vertical orientation in relation to the top surface of the pallet bottom following assembly of the product display container without screws or bolts. During shipment, prior to assembly, or following disassembly of the product display container, the four side walls may be folded at their hinge connection points so as to lay substantially flat for shipment or storage.

Another aspect of the techniques described herein provides a collapsible product display container that also serves as a marketing vehicle for product advertisements and sales banners at the point of sale following the assembly of the container. The container may comprise a pallet bottom and four hingedly connected side walls whose bottom edges may be "snapped" into place in the one or more clamping attachment protrusions that are affixed to the pallet bottom such that the four side walls will then be in upright vertical positions attached to said pallet bottom following assembly. The container may further comprise a first advertisement display case that is hingedly connected by one or more hinges to the uppermost edge of the back side wall, and which is designed to hold advertising banners or marketing materials after assembly at the point of sale. During assembly of the container, the first advertisement display case may be rotated upwards pivoting around the one or more hinges connecting it to the back side wall such that the first advertisement display case is raised above but into a vertical plane with the back side wall and therefore has a vertical planar alignment with the back side wall of the display container. The first advertisement display case may be held in the vertical planar alignment in relation to the container's back side wall by use of a pin that can be inserted through a cylindrical-shaped guide member that is rigidly attached to the first advertisement display case and into cylindrical-shaped receiving means that is rigidly attached to the back side wall. The container may further comprise a second advertising display case that is rigidly affixed to the front side wall of the container and which may also be used for display of an additional advertising banner or other marketing material at the point of sale.

DESCRIPTION OF THE DRAWINGS

It is noted that the appended drawings illustrate only exemplary embodiments of the techniques described herein and are, therefore, not to be considered limiting of its scope, for the techniques may admit to other equally effective embodiments.

DETAILED DESCRIPTION

The techniques described herein provide an apparatus for a collapsible product display container comprising a pallet bottom configured to allow traditional lifting and moving of the display container and four side walls. The four side walls of the container are not attached to the pallet bottom during shipment or storage of the collapsible product display container. The four side walls are permanently hingedly connected to each other. At the time of assembly of the container, the four side walls may be easily attached in an upright vertical position to the pallet bottom by means of one or more clamping attachment protrusions on the pallet bottom so as to form a rectangular cuboid structure that is open at the top upon final assembly of the container that is capable of holding products to be sold. The opening at the top of the container allows customers to reach in and remove products from the container at the point of sale. The product display container may also include desirable features for use in the marketing and sales of products at the point of sale, namely, two separate advertisement display cases that can hold removable product display signage.

Figure 1:
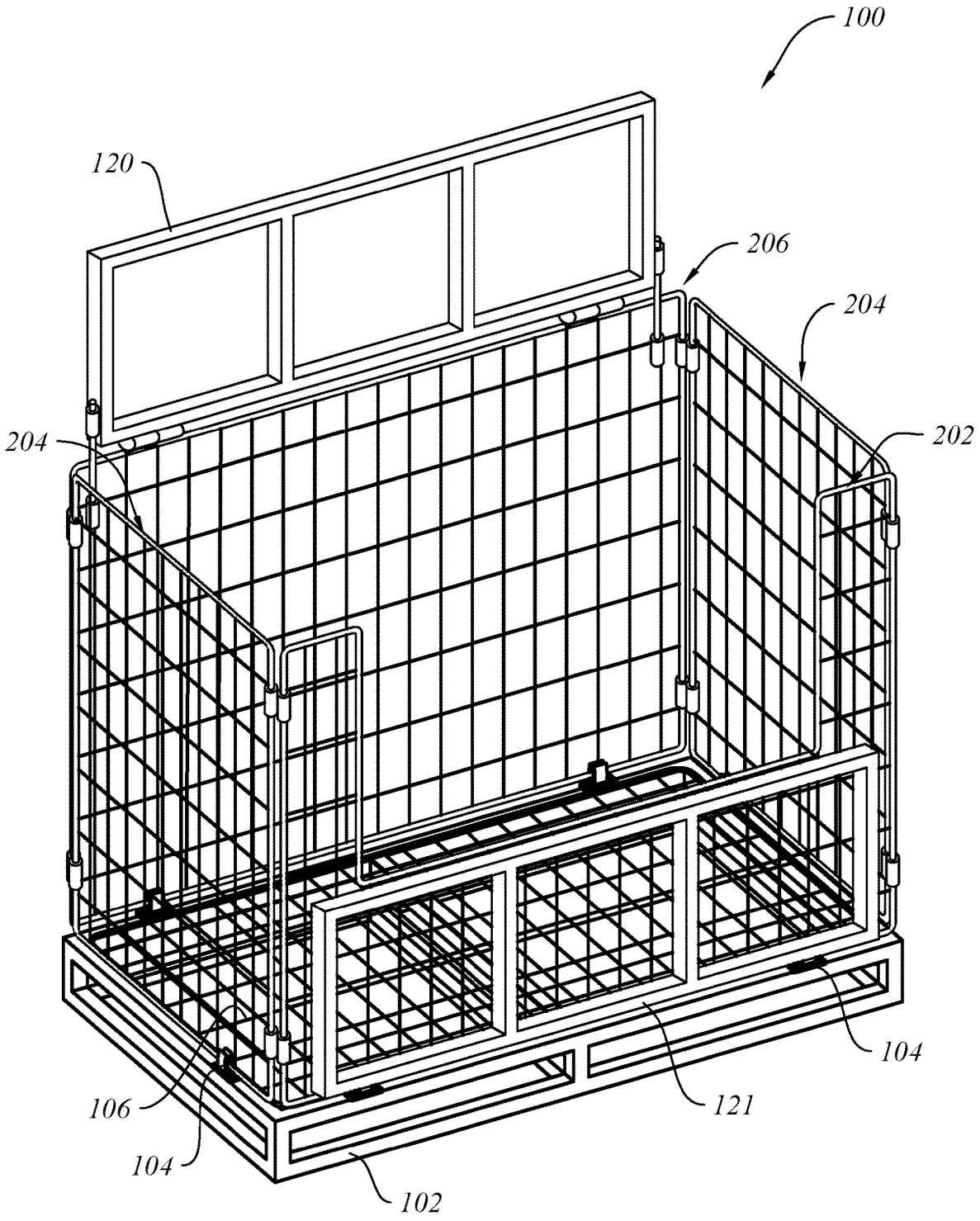
FIG. 1 is a perspective view of an assembled collapsible product display container.

FIG. 1 shows a perspective view of the collapsible product display container 100, having a pallet bottom 102 with a pallet bottom top surface 106 wherein the pallet bottom is configured to allow traditional lifting and moving of the display container 100, such as with a forklift or other similar equipment. A front side wall 202 is permanently hingedly connected to two lateral side walls 204 that are each, in turn, permanently hingedly connected to opposing sides of a back side wall 205. After assembly of the container 100, the front side wall 202, the two lateral side walls 204, and the back side wall 206 are each detachably held in a vertical upright position by a clamping attachment protrusion 104 that extends upward from the pallet bottom 102 and into which an edge of each of the side walls may be snapped into place during assembly or removed during disassembly of the container. In a preferred embodiment, the collapsible product display container 100 has a first advertisement display case 120 that is pivotably connected by a hinge to the topmost edge of the back side wall 206. In the preferred embodiment, the collapsible product display container 100 also has a second advertisement display case 121 that is rigidly affixed to the lower front portion of the front side wall 202 of the container 100.

Because the four side walls of the product display container are hingedly connected, they may be laid substantially flat when they are not connected to the pallet bottom. When laid flat, the hingedly connected side walls may be shipped to a product supply company, along with the pallet bottom, as an unassembled, relatively compact arrangement to lessen shipping and handling costs. A supplier of product may then easily assemble the product display container at the point of sale by pulling open the hingedly connected side walls, standing the four side walls upright so that their joint perimeter forms a rectangle, and then attaching the bottom edges of each of the four side walls to the pallet bottom by means of snapping them into place within the one or more clamping attachment protrusions connected to the pallet bottom. The supplier of product may then fill the product display container with products to be sold. The pallet aspects of the container may than be used to assist in the movement and placement of the container and any product that the supplier may have placed into the container at the point of sale location (such as a retail store).

The product display container may be manufactured from a wide variety of materials. For example in one embodiment the container may be formed from thick rigid metal wire having a mesh pattern. In one embodiment, all of the side walls and the pallet bottom may be formed of such metal wire material. It is understood that the product display container could also be made of metal without a mesh pattern, or made of plastic, or some other rigid material or combinations thereof. In addition, the various components may be formed via a mesh pattern, solid sheets, or other arrangement or combinations thereof. In fact, it will be recognized that the advantageous container provided herein that combines a collapsible mechanism with advantageous product shipping and display functionality is not limited to any particular type of material.

Figure 2:
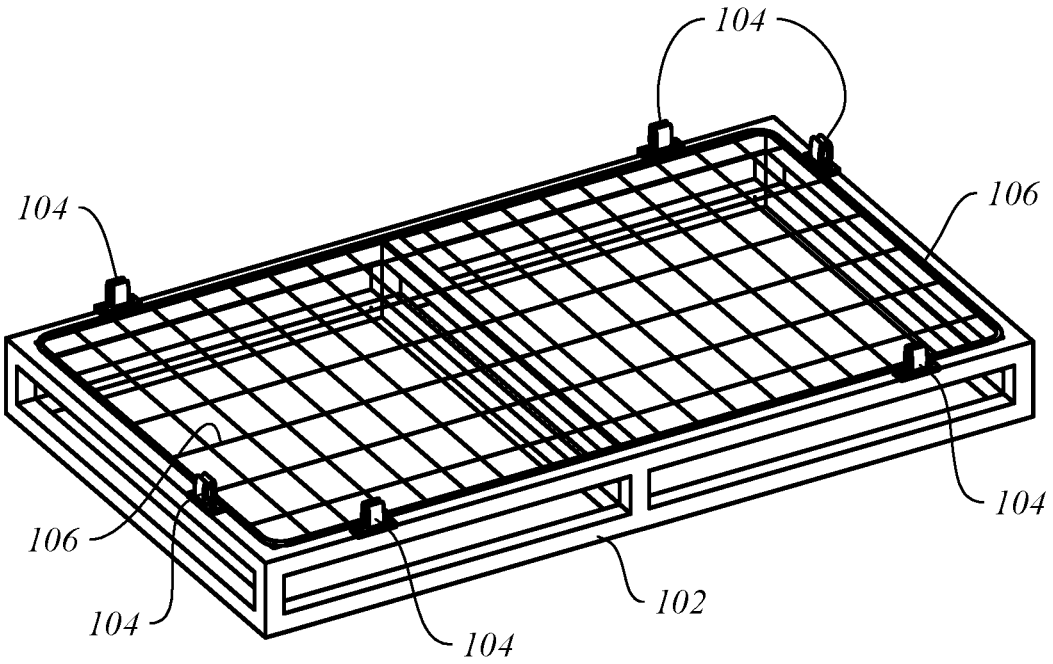
FIG. 2 is a perspective view of the pallet bottom of the collapsible product display container prior to assembly or after disassembly of the product display container.

FIG. 2 is a perspective view of the pallet bottom 102 of the product display container 100 prior to assembly or after disassembly of the container 100. In a preferred embodiment, the pallet bottom 102 has a multiplicity of clamping attachment protrusions 104 that extend upward from the edges of the pallet bottom 102. As shown in FIG. 2, in a preferred embodiment the pallet bottom top surface 106 is made from a thick rigid metal wire having a mesh pattern.

Figure 3:
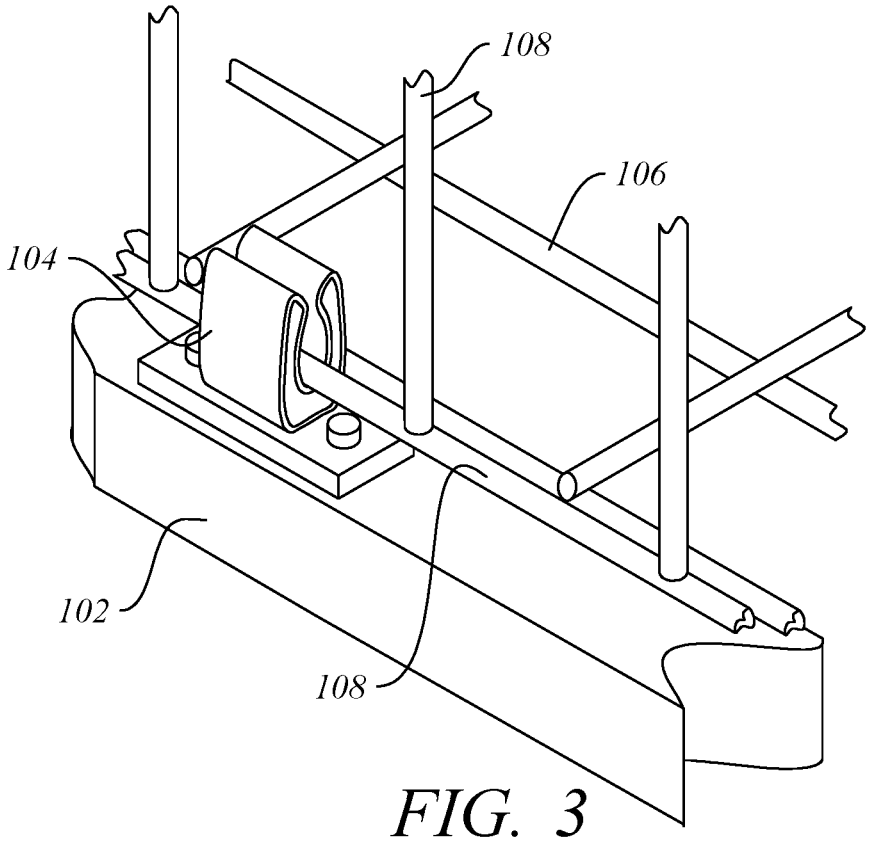
FIG. 3 is a detail view of a clamping attachment protrusion that is rigidly affixed to an edge of the pallet bottom of the product display container illustrating the manner in which it holds a side wall in an upright vertical position following assembly of the container.

FIG. 3 is a detail view of a section of the pallet bottom 102 and a lateral side wall 204 demonstrating the manner in which a lateral side wall 204 may be reversibly connected to the pallet bottom 102 in the assembled product display container 100. As shown, in this embodiment the lateral side wall surface 108 of the lateral side wall 204 is made of a thick rigid metal wire having a mesh pattern that can be snapped into place and held within the jaws of the clamping attachment protrusion 104 that is rigidly affixed to an edge of the pallet bottom 102 of the collapsible product display container 100. While FIG. 3 shows the manner in which a lateral side wall 204 is attached to the pallet bottom 102, it can be appreciated that in the fully assembled product display container 100, all four side walls will be held in an upright vertical position by one or more clamping attachment protrusions 104 in the same manner that is illustrated in FIG. 3.

Figure 4:
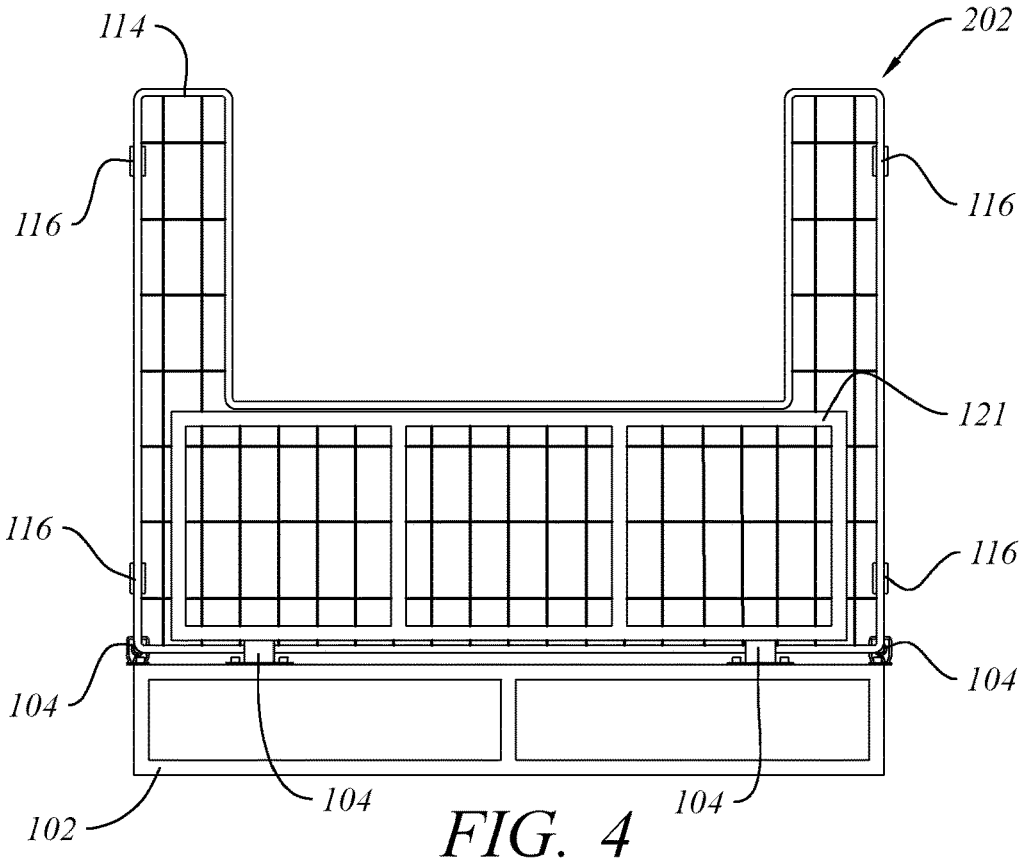
FIG. 4 is a front view of the collapsible product display container following assembly (note: the back side wall of the container is not shown in this view in order to better illustrate the appearance of the front side wall of the container).

FIG. 4 shows the front side wall 202 of the product display container 100 as it appears when assembled on top of the pallet bottom 102. The front side wall 202 is attached to the pallet bottom 102 by means of one or more clamping attachment protrusions 104. The front side wall 202 is permanently hingedly connected to the lateral side walls 204 by one or more wall hinges 116. In a preferred embodiment, a second advertisement display case 121 is rigidly attached to the front side wall 202. (Note: The back side wall 206 and the lateral side walls of the product display container are not shown in FIG. 4. in order to better illustrate the features of the front side wall 202 after assembly of the container).

Figure 5:
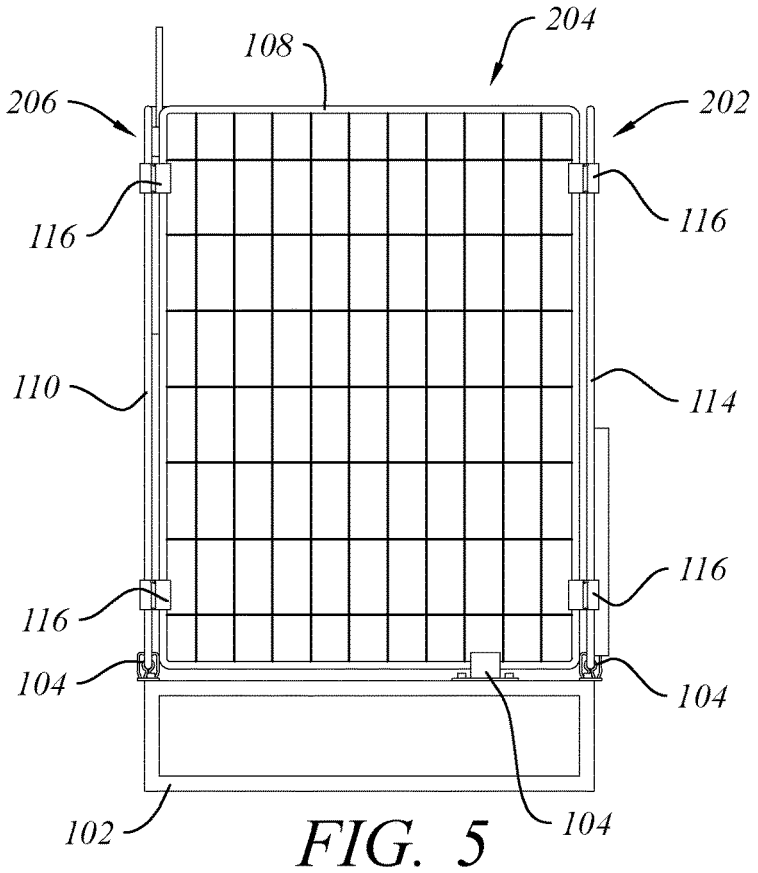
FIG. 5 is a side view of the collapsible product display container that demonstrates a lateral side wall of the container located between the front side wall and back side wall following assembly.

FIG. 5 is a side view of the assembled product display container 100 that shows one of the lateral side walls 204 hingedly connected to the front side wall 202 and also to the back side wall 206 by means of one or more wall hinges 116. As illustrated, during assembly the lateral side wall 204, the front side wall 202, and the back side wall 206 are each reversibly attached to the pallet bottom 102 in a vertically upright position by at least one clamping attachment protrusion 104. In a preferred embodiment, the lateral side wall surface 108, the front side wall surface 114, and the back side wall surface 110, are each made of a thick rigid metal wire having a mesh pattern that may be snapped into place within the clamping attachment protrusion(s) 104 located on the pallet bottom 102 of the container.

Figure 6:
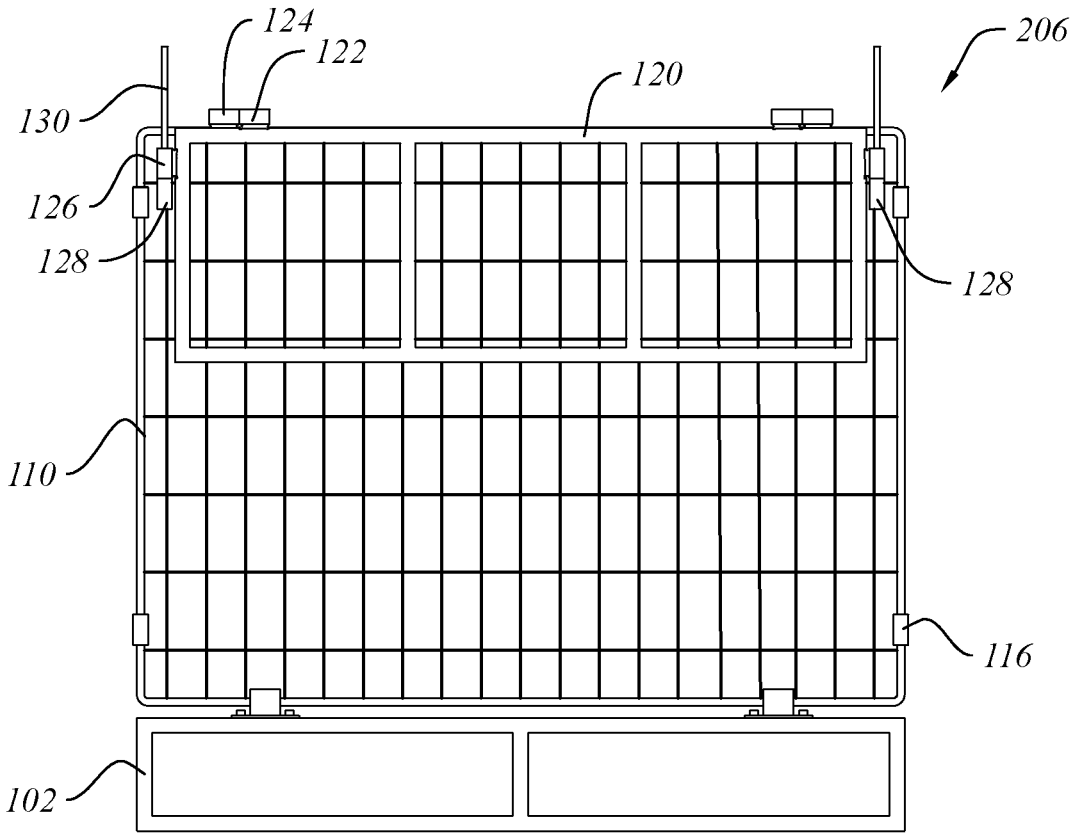
FIG. 6 is a back view of the collapsible product display container that demonstrates the back side of the container at a time when the first advertisement display case has not yet been raised into a vertical planar alignment with the back side wall of the container.
Figure 7:
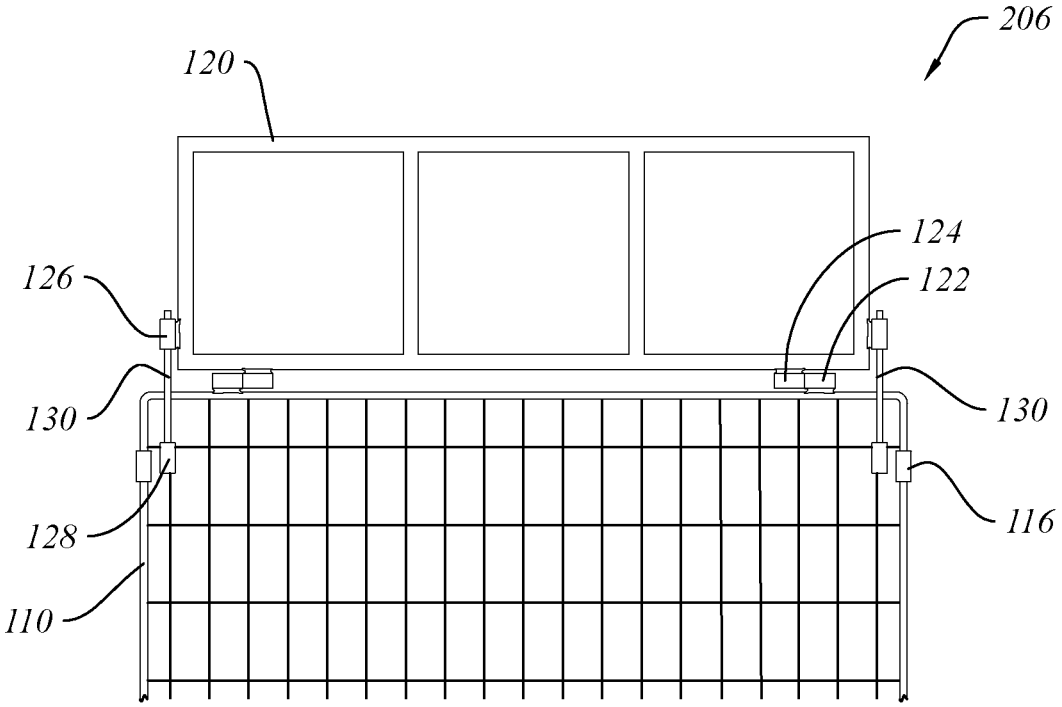
FIG. 7 is a back view of a portion of the collapsible product display container demonstrating the appearance of the back side of the container after the first advertisement display case has been raised into a vertical planar alignment with the back side wall of the container.

With reference to FIG. 6 and FIG. 7, a first advertisement display case 120 may be hingedly connected to the top edge of the back side wall 206 with a display hinge member 124 that allows for the first advertisement display case 120 to be pivoted upward and rotated around a display hinge member 124 that cooperates with a back side hinge member 122 so that the first advertisement display case may be moved into a vertical planar position above the back side wall 206 as shown in FIG. 7. During shipment or storage of the container, the first advertisement display case 120 may be held in a lowered (non-rotated) position as shown in FIG. 6 by means of a removable pin 130 that may be vertically inserted through a cylinder-shaped guide member 126 that is rigidly affixed to the first advertisement display case 120 and then inserted below into a cylinder-shaped receiving means 128 located on the back side wall 206. In this manner, the first advertisement display case 120 will be prevented from moving and will not be allowed to pivot or rotate upwards away from the back side wall 206 during shipment or storage. During assembly of the product display container at the point of sale, the pin 130 may be removed from the cylinder-shaped receiving means 128 and from the cylinder-shaped guide member 126, which will allow for the first advertisement display case 120 to be pivoted upwards around the back side hinge member 122 and display hinge member 124 and away from the back side wall 206 and thereby rotated into a vertical planar alignment above the back side wall 206 as shown in FIG. 7. At this position, the pin 130, may then be inserted through the cylinder-shaped guide member 126 that is affixed to the first advertisement display case 120 and then downwards into the cylinder-shaped receiving means 128 that is located below on the back side wall 206. In this manner, the pin 130 will hold the product display case 120 in the upright vertical alignment that is illustrated in FIG. 7 while preventing further rotation of the first advertisement display case.

Figure 9:
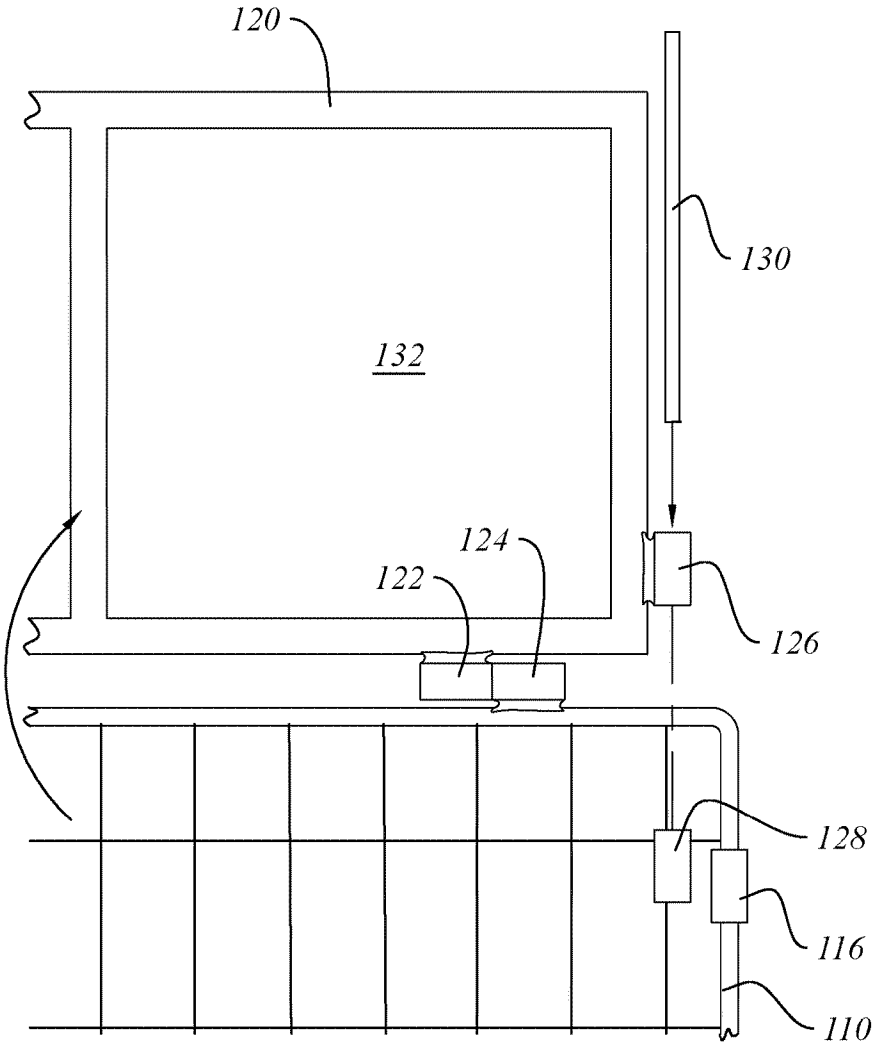
FIG. 9 is a detail view of a portion of the back side wall of the collapsible product display container demonstrating the container immediately after the time that the first advertisement display case has been raised into vertical planar alignment with the back side wall of the container and demonstrating how the pin will be placed in order to hold the first advertisement display case in the vertical planar position above the back side wall.
Figure 8:
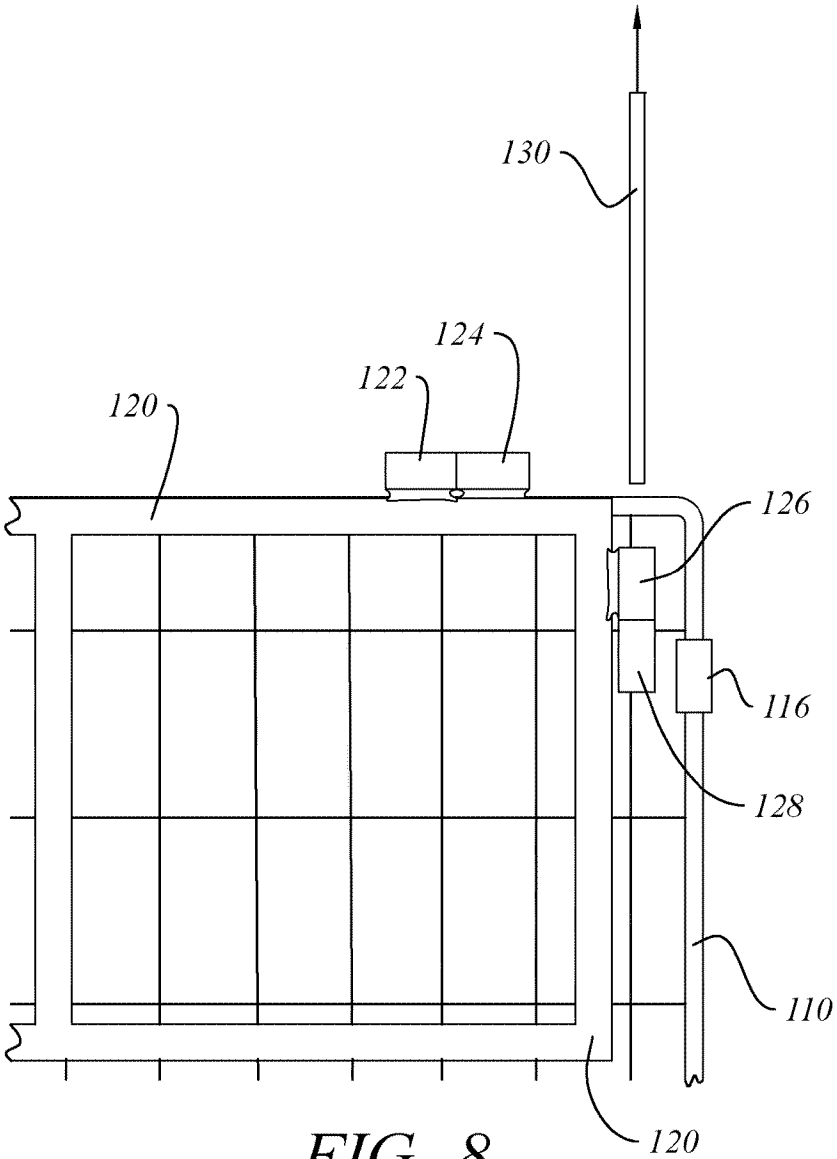
FIG. 8 is a detail view of a portion of the back side wall of the collapsible product display container demonstrating the container immediately prior to the time that the first advertisement display case is raised into a vertical planar alignment with the back side wall of the container and showing removal of a pin so that the first advertisement display case can be raised into vertical planar alignment with the back side wall.

The first advertisement display case 120 can thus be rotated either upward or downward in relation to the back side wall 206 by means of the hinging mechanism provided by the back side hinge member 122 and display hinge member 124 provided that the pin 130 has first been removed from the cylinder-shaped guide member 126 and the cylinder-shaped receiving means 128. As shown in FIG. 6, the first advertisement display case 120 may be held in a downward configuration that is substantially flat against the back side wall 206 by means of insertion of the pin 130. As shown in FIG. 8, the pin 130 may be removed from the guide member 126 and the cylinder-shaped receiving means 128 so that upward rotation of the first advertisement display case 120 may occur. Rotation of the first advertisement display case 120 will occur until it is in a vertical planar alignment above the back side wall 206 as shown in FIG. 7 and FIG. 9. At that point, the pin 130 may be inserted through the guide member 126 and into the cylinder-shaped receiving means 128 as shown in FIG. 9 so that further rotation of the first advertisement display case 120 is prevented. The placement of the pin 130 into the guide member 126 and the cylinder-shaped receiving means 128 will cause the first advertisement display case 120 to stand upright. Thereafter, an advertising banner or other marketing material may be placed on or in the first advertisement display case 120 at the point of sale.

FIG. 1 and FIG. 4 show an embodiment in which the second advertisement display case 121 is rigidly affixed to the front side wall 202 of the product display container 100. The second advertisement display case 121 may be used at the point of sale to hold or display advertising or marketing materials regarding the products that may be placed within the container. As further shown in FIG. 1 and FIG. 2, in one embodiment the front side wall 202 may be constructed in such a shape that when the container 100 is assembled, the front side wall 202 provides an open space above the second product display case 121 that more easily allows product to pass into and out of the container 100. Such an open space in the front side wall 202 allows customers to more easily remove product from the container 100.

A highly versatile container is therefore provided having a variety of independent features that may be used together or in alternative embodiments may be comprised of some subset of the features. For example, the container is collapsible into two main pieces to provide an ease of shipping and storage of the container itself. The container includes a pallet bottom that assists in shipping and movement of the container (for example to and at a point of sale location), and also includes the four side walls that are permanently hingedly connected in the manner described above and as illustrated in the drawings, but which may be laid substantially flat for shipping or storage of the container. The container may be easily assembled from the two main pieces (pallet bottom and four side walls) without the need for additional hardware, screws and the like. Further, a variety of point of sale uses may be achieved by embodiments of the container providing an open space in the front side wall and/or two separate advertisement display cases that may be optionally included as parts of container.

It will be recognized that the various hinges, receiving mechanisms, pins, and other elements described herein are merely illustrative. One skilled in the art will recognize the functionality described herein may be achieved through a wide variety of hinges, receiving mechanisms, pins, locking mechanisms, attachment means, or the like. It will also be recognized that the container described herein has a variety of independent features that may be used separately from each other and all features are not required in order to gain the benefit of the concepts disclosed herein.

Further modifications and alternative embodiments of the techniques described herein will be apparent to those skilled in the art in view of this description. It will be recognized, therefore, that the techniques described herein are not limited by these example arrangements. Accordingly, this description is to be construed as illustrative only and is for the purpose of teaching those skilled in the art the manner of carrying out the techniques described herein. It is to be understood that the forms of the techniques described herein shown and described are to be taken as the presently preferred embodiments. Various changes may be made in the implementations and architectures. For example, equivalent elements may be substituted for those illustrated and described herein and certain features of the techniques described herein may be utilized independently of the use of other features, all as would be apparent to one skilled in the art after having the benefit of this description of the techniques.

What is claimed is:

1. A collapsible product display container, comprising:

a pallet bottom configured to allow lifting and moving of the display container;

four side walls that may be removably attached to the pallet bottom;

clamping attachment protrusions rigidly affixed to the pallet bottom;

wherein the four side walls may be removably attached to the pallet bottom using the clamping attachment protrusions to hold the four side walls in a vertical upright position in relation to the pallet bottom such that the assembled container will have the shape of a rectangular cuboid that is open at the top;

wherein the four side walls are removably attachable to the pallet bottom without screws, bolts, or pins;

wherein the four side walls are permanently hingedly interconnected such that they may be folded substantially flat or they may be pulled apart into a substantially rectangular configuration and then attached in that substantially rectangular configuration to the pallet bottom using the clamping attachment protrusions such that the four side walls while in the substantially rectangular configuration will be attached to the pallet bottom in a vertical upright alignment in relation to the pallet bottom and will serve as the sides of the assembled container;

wherein the four side walls are comprised of: a front side wall hingedly connected on one of its sides to a first lateral side wall and hingedly connected on its opposite side to a second lateral side wall; a back sidewall that hingedly connected on one of its sides to the first lateral side wall and hingedly connected on its opposite side to the second side wall; wherein prior to assembly of the container or after disassembly of the container all four side walls may be moved using hinging action so that the front side wall and the back side wall are parallel to each other and the first lateral side wall and second lateral side wall are parallel to each other such that the four side walls may be laid substantially flat prior to assembly or after disassembly of the container;

The container further comprising:

a first advertisement display case that is hingedly connected to the top of the back side wall;

a cylinder-shaped guide member that is rigidly affixed to the first advertisement display case;

a cylinder-shaped receiving means that is rigidly affixed to the back side wall and is located directly underneath the cylinder-shaped guide member;

a pin that may be inserted through the cylinder-shaped guide member and downward into the cylinder-shaped receiving means in order to prevent rotation of the first advertisement display case either toward or away from the back side wall.

2. The container of claim 1, wherein a second product display case is rigidly affixed to the front side wall.

3. The container of claim 2, wherein there is an open space in the top of the front side wall that may be used to more easily remove items that may have been previously placed within the container.

4. The container of claim 1, wherein the first advertisement display case is configured to hold removable product display signage.

5. The container of claim 2, wherein the second advertisement display case is configured to hold removable product display signage.

* * * * *